US005314644A

United States Patent [19]

Michelsen et al.

[11] Patent Number: 5,314,644

[45] Date of Patent: May 24, 1994

[54] MICROBUBBLE GENERATOR

[75] Inventors: Donald L. Michelsen, Blacksburg; Felix Sebba, late of Blacksburg, Va., by Thomas M. Murphy, executor

[73] Assignee: Virginia Polytechnic Institute and State University, Blacksburg, Va.

[21] Appl. No.: 962,903

[22] Filed: Oct. 19, 1992

[51] Int. Cl.[5] ..... B01F 3/04

[52] U.S. Cl. ..... 261/84; 366/307; 366/321; 261/DIG. 75

[58] Field of Search ..... 261/84, DIG. 75; 366/307, 321

[56] References Cited

U.S. PATENT DOCUMENTS

| | | | |
|---|---|---|---|
| 25,453 | 1/1859 | Taylor | 366/307 |
| 1,427,271 | 8/1922 | Eger | 366/321 |
| 2,706,108 | 4/1955 | Miner | 261/84 |
| 3,012,977 | 12/1961 | Wilson et al. | 366/307 |
| 3,313,093 | 4/1967 | Guggenberger et al. | 261/DIG. 7 |
| 3,427,003 | 2/1969 | Schneider et al. | 366/321 |
| 3,471,131 | 10/1969 | Fritzweiler et al. | 366/307 |
| 3,900,420 | 8/1975 | Sebba | 261/116 |
| 4,308,144 | 12/1981 | Saito | 261/DIG. 75 |
| 4,339,206 | 7/1982 | Ahs | 366/307 |
| 4,577,974 | 3/1986 | Prough et al. | 366/307 |
| 4,728,731 | 3/1988 | Raehse et al. | 366/307 |
| 4,931,225 | 6/1990 | Cheng | 261/DIG. 75 |
| 4,965,022 | 10/1990 | Gitz | 261/DIG. 75 |
| 5,188,808 | 2/1993 | Gilja et al. | 366/307 |

FOREIGN PATENT DOCUMENTS

| | | | |
|---|---|---|---|
| 803363 | 10/1958 | United Kingdom | 366/321 |
| 1007571 | 10/1965 | United Kingdom | 261/84 |

OTHER PUBLICATIONS

Felix Sebba, "An Improved Generator for Micron--Sized Bubbles", *Chemistry and Industry* (Feb. 4, 1985).

*Primary Examiner*—Tim Miles

*Attorney, Agent, or Firm*—Mason, Fenwick & Lawrence

[57] ABSTRACT

Means are provided for supplying a liquid surfactant solution, for supplying a gas under pressure, for mixing the liquid surfactant solution and the pressurized gas to form a liquid coarse dispersion of relatively large gas bubbles, and for receiving the liquid coarse dispersion to generate a liquid fine dispersion of relatively small micron-size gas bubbles. The fine dispersion generator mean generally comprises a cylindrical chamber having an inlet for admitting the liquid coarse dispersion into the chamber, and an outlet for discharging a liquid fine dispersion of relatively small micron-size gas bubbles from the chamber; a cylindrical rotor which is mounted within the chamber and has an outer side surface which is provided with means for imparting axial motion components in opposite directions to various portions of the liquid dispersion adjacent to rotor; and a plurality of baffles located between the rotor outer side surface and the chamber inner side wall surface which are spaced apart around the rotor and where each baffle has an inner longitudinal edge which faces the rotor outer side surface and is separated therefrom by a first gap within which the large gas bubbles are sheared into small micron-size gas bubbles.

12 Claims, 3 Drawing Sheets

MICROBUBBLE GENERATOR

FIELD OF THE INVENTION

The present invention relates to apparatus for generating microbubbles useful in a variety of applications such as in-situ bioremediation and fine particle flotation assistance. In particular, the invention permits the continuous production from a surfactant solution of large quantities of relatively uniform small microbubbles in a high quality fine dispersion which contains little void or unconsolidated gas.

BACKGROUND OF THE PRESENT INVENTION

In recent years, dispersions of micron-size bubbles (microbubbles) have become increasingly important for various applications in the fields of chemistry, chemical engineering and microbiological engineering. Improved flotation processes involving fine particulate and oil dispersions are encountered in industrial sanitary and food processing waste waters, and of the fighting of fires.

A microbubble dispersion can consist of very small surfactant-stabilized bubbles, typically formed as a 50% to 65% dispersion of gas in a liquid. The quality of a microbubble dispersion may be defined as the percentage of gas in the gas plus liquid dispersion. Gas bubbles stabilized with a surfactant (soapy) film tend to maintain a small size with or without stirring. Surfactant-stabilized microbubbles also tend to resist coalescence because the surfactant tends to orient at the gas-liquid interface, forming a charged bubble surface that repels other bubbles. The less that a microbubble dispersion coalesces in one minute, the better is its stability. The microbubbles typically have diameters of 15 to 120 microns, but they also may be larger or smaller than these sizes. They often are referred to as colloidal gas aphrons (CGA) to underscore the colloidal properties of these very small bubbles. The word "aphron" has been coined to mean a fluid encapsulated in a thin aqueous shell—a true bubble. A CGA consists of an inner pocket of air surrounded by an aqueous double layer film which is surrounded by the continuous phase. Both the gas interface and the film/continuous phase interface of the film have higher surfactant concentrations than the bulk fluid. This double layer phenomenon stabilizes the CGAs by preventing them from coalescing. First, an electric potential gradient is set up by the orientation of the molecules at the interfaces. CGAs created with the same surfactant will have similar surface charges and will repel each other, preventing contact. Also, the film acts as a slightly springy wall when CGAs come close to each other. The combination of these two effects results in a foam that is stable enough to be pumped, has a very large surface to volume ratio and exhibits a slow rise velocity.

In early studies, CGAs were produced by a venturi device that required large recirculation velocities in order to form a uniform bubble size distribution. See, for example, U.S. Pat. No. 3,900,420 (Sebba). An improved CGA generator was later devised which used a spinning disk bracketed by a pair of baffles to produce 1-2 liters of CGAs per minute. Other devices for microbubble generation also have included close tolerance rotary pumps, packed beds of solid particles including glass spheres, air-sparged hydrocyclones, and a tube reactor using sintered bayonet fingers.

However, the aforementioned spinning disk method to produce microbubble dispersions in small quantities may have limited potential for economical scale-up, and no device to date is believed to provide continuous high volume generation of a fine microbubble dispersion. Low-cost efficient methods and devices for producing high quality dispersions of small microbubbles on a large scale need to be developed to take advantage of many industrial applications where such dispersions could significantly reduce energy consumption and cost in the performance of these applications. For example, enormous electrical costs are incurred in sparging (beating) air into sludge in order for biodegradation to occur in activated sludge processing plants. The present invention provides a novel technique for economically and continuously producing large quantities of high quality microbubble dispersions at the rate of 30 to 50 gallons per minute, and it represents a considerable improvement in generating microbubbles with good stability and small bubble size, minimum void gas and reasonable operating cost.

SUMMARY OF THE INVENTION

Accordingly, it is a primary object of the present invention to permit the continuous production from a surfactant solution of large quantities of relatively uniform small microbubbles in a high quality fine dispersion which contains little void or unconsolidated gas.

Another object of the present invention is to provide premixing and stabilization means for producing a liquid coarse dispersion of relatively large gas bubbles which is then sheared by additional generator means into a fine dispersion of relatively small micron-size bubbles.

A further object of the present invention is to provide novel microbubble generator means for continuously shearing a coarse dispersion of large bubbles into a fine dispersion of microbubbles with good stability and small bubble size.

These and other objects of the invention are achieved in general by providing means for supplying a liquid surfactant solution; means for supplying a gas under pressure; means for mixing the liquid surfactant solution and the pressurized gas to form a liquid coarse dispersion of relatively large gas bubbles; and means for receiving the liquid coarse dispersion to generate a liquid fine dispersion of relatively small micron-size gas bubbles. The fine dispersion generator means generally comprises a cylindrical chamber having an inner side wall surface and first and second opposite inner end surfaces; an inlet at the first end of the chamber for admitting the liquid coarse dispersion into the chamber, and an outlet at the second end of the chamber for discharging a liquid fine dispersion of relatively small micron-size gas bubbles from the chamber; a cylindrical rotor which is mounted within the chamber for rotation about an axis longitudinally extending between the chamber first and second inner end surfaces, the rotor having an outer side surface which is provided with means for imparting axial motion components in opposite directions to various portions of the liquid dispersion adjacent to the outer side surface; and a plurality of longitudinally extending baffles located between the rotor outer side surface and the chamber inner side wall surface which are spaced apart around the rotor and where each baffle has an inner longitudinal edge which faces the rotor outer side surface and is separated therefrom by a first gap within which the large gas bubbles are sheared into small micron-size gas bubbles.

DETAILED DESCRIPTION OF THE PREFERRED EMBODIMENTS

Figures 1A, 1B, 2:
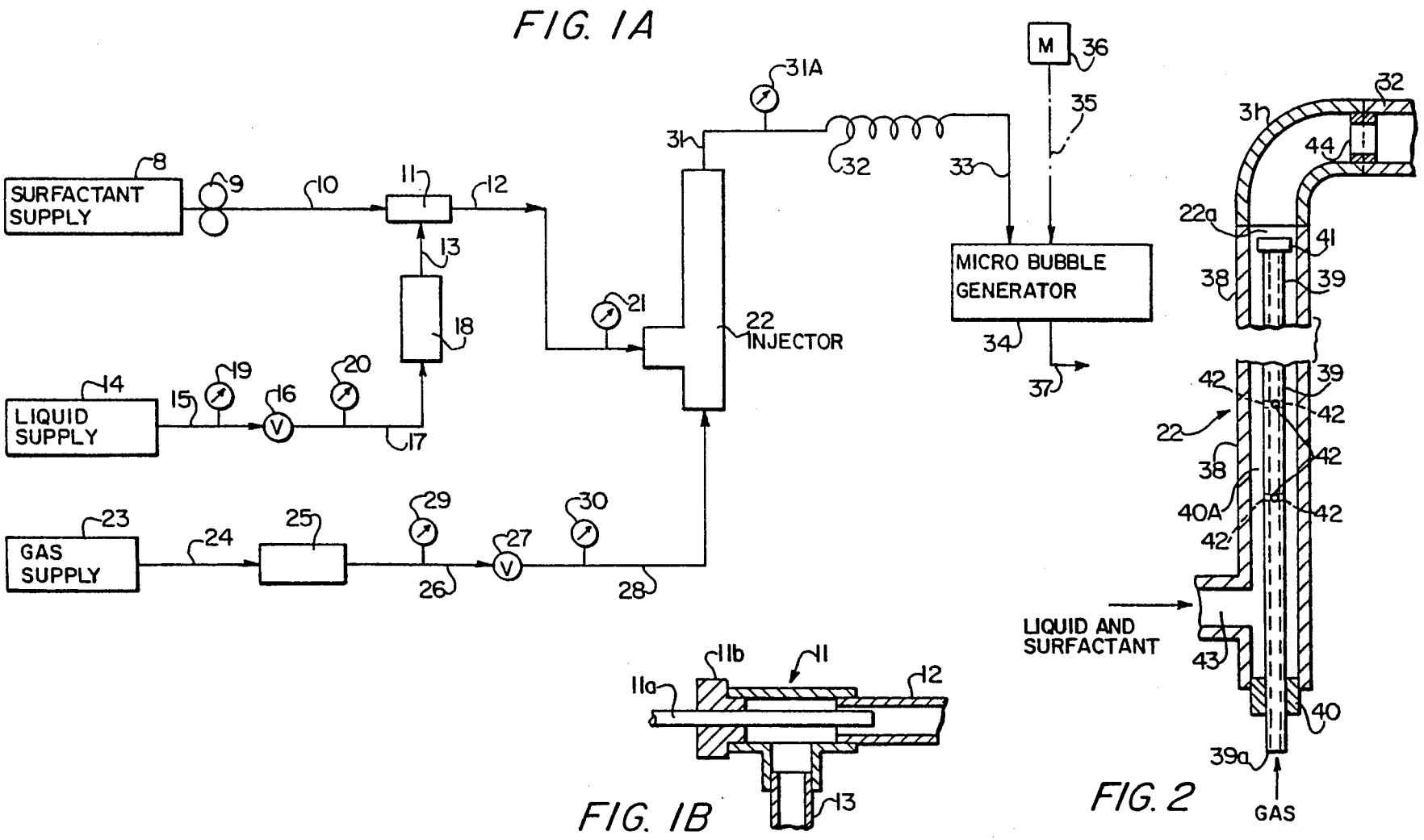
FIG. 1A is a diagrammatic piping drawing which also shows the major components of the novel microbubble generator system.
FIG. 1B is a partial sectional view of a mixing pipe tee component used in the FIG. 1A system.
FIG. 2 is a partial sectional view of injector structure used in the FIG. 1A system for mixing a liquid surfactant solution and gas to create a liquid coarse dispersion of gas bubbles.

In describing the subject invention illustrated in the drawings, specific terminology is used for the sake of clarity. However, the invention is not intended to be limited to the specific terms so selected, and each specific term includes all technically equivalent terms for components operating in a similar manner to accomplish a similar purpose.

FIG. 1A is a diagrammatic piping drawing which also shows the major components of the novel microbubble generating system that comprises the present invention. A surfactant supply means 8 is the source of a concentrated solution of any suitable soap or soap blend that is pumped using a calibrated positive displacement pump 9. Alternatively, the concentrated surfactant solution from supply means 8 can be under pressure and controlled by a control valve followed by a small rotameter. This concentrated surfactant passes through pipe 10 and is combined or mixed in pipe tee 11 connected to pipe 12 with suitable liquid under pressure from pipe 13. This pressurized liquid, which typically is water, is provided from the liquid supply means 14 by way of pipe 15, control flow valve 16, pipe 17, rotameter 18 and pipe 13 to pipe tee 11 as shown in detail by the FIG. 1B section view. Gauges 19 and 20 monitor the pressure of the liquid in pipes 15 and 16. Pipe tee 11 may consist of a ¼" tubing **11*a* connected to pipe 10 and which passes through a block 11*b* and extends downstream into pipe 12 for enhancing the mixing action. Pipe 12 may be about 1.5" in diameter, or at least be a size which promotes turbulent flow therethrough for sufficient mixing of the surfactant and liquid. If pipe 12** is too large, this mixing may be inadequate.

The surfactant concentration and blend in pipe 12 may be varied within limits. For example, the concentration in pipe 12, after the surfactant from supply 8 has been mixed into a larger flow of liquid from pipe 13, can range as high as 500 ppm to 1000 ppm, or even as high as 10,000 ppm, but typically it is between 200 ppm and 100 ppm. One or more surfactants also can be used either alone or in mixtures having blend ratios from 100% anionic (e.g., linear sodium dodecyl benzene sulfonate which is available under the brand name "Polystep A-7") to 100% non-ionic (e.g., secondary C12 alcohol ethoxylate (15 groups) which is available under the brand name "Tergitol 15-S-12"). Stability generally decreases as the surfactant concentration drops. However, a 100 ppm to 150 ppm surfactant concentration of a 75% non-ionic/25% anionic surfactant blend has proved effective in continuously producing a large volume of a stable, 58–70% microbubble dispersion with a low energy requirement.

The surfactant-pressurized water mixture in pipe 12 is monitored by pressure gage 21 and is applied to one input of bayonet injector means 22 in which this mixture is combined with suitable pressurized gas from supply means 23. Air can be used for this purpose, which is supplied at constant pressure from supply means 23 through pipe 24, rotameter 25, pipe 26, control valve 27 and pipe 28 to a second input of injector means 22. Pressure gauges 29 and 30 also monitor this gas flow. Other gases may also be useful for certain applications, such as oxygen, nitrogen, ozone, methane, propane, carbon dioxide, sulfur dioxide, chlorine, and hydrogen sulfide, as well as any number of reactive gases.

Injector means 22, whose details are shown in FIG. 2, operates to mix the gas in pipe 28 with the surfactant-water solution in pipe 12. The resulting surfactant-water-gas mixture from injector 22 is a liquid coarse dispersion primarily containing relatively large gas bubbles, which is supplied under pressure via injector output pipe 31 to a long stabilization pipe coil 32 that provides sufficient hold time, with some mixing, to diffuse the surfactant to the gas-liquid interface. Pressure gage 31A also monitors the output from injector 22. However, the coarse or large bubbles from injector 22 are not small enough to be considered colloidal since they would phase separate quickly if poured into a beaker.

After leaving the stabilization pipe coil 32, the surfactant-liquid-gas coarse dispersion flows in pipe 33 to enter a novel continuous microbubble generator device 34 whose various preferred embodiments are shown in FIGS. 3 through 8. This microbubble generator 34, which includes a cylindrical rotor component spun by shaft 35 of motor 36, performs an internal shearing operation on the incoming coarse dispersion to create a large volume per minute of relatively uniform small microbubbles in a liquid high quality fine dispersion that exits from the generator by way of output pipe 37. This fine dispersion resembles a thick cream with much of its volume made up of small microbubbles. For example, the FIG. 1A system can produce up to 110 liters per minute of 45 +/−40 micron oxygen microbubbles in a fine dispersion comprised of 65% oxygen in microbubble form and 35% water. Higher volume rates also appear to be possible from systems employing the novel concepts of the present invention. Injector 22 and coil 32 are used to assure a homogeneous dispersion (typically 65%/35%) prior to forming the fine microbubbles with minimum void gas in the spinning generator device 34. Void gas is the portion of gas (air) in the generator which is not incorporated into the microbubbles. However, it should be noted that the percent of gas utilization decreases as the surfactant concentration decreases, which means that a greater volume of void gas would pass through the generator 34 without forming microbubbles.

The preferred construction of the bayonet injector 22 is shown in detail by the FIG. 2 section view. It consists of an elongated, outer tubular shell or pipe 38 within which is centered another elongated pipe 39 of smaller diameter. Pipe 39 is spaced from the inner surface of pipe 38 by any suitable means, such as plug 40 at the lower end of pipe 38 which also seals said lower end, so as to form an annular space 40A between pipes 38 and 39. For example, pipe 38 can be about 22" long and have an inner diameter of about 1", while inner pipe 39 can have a 0.5" diameter and extend approximately the full length of pipe 38. The upper end of inner pipe 39 also has a sealing cap or plug 41 inserted therein. The exposed outside diameter of plug 41 is slightly larger than the outside diameter of pipe 39, e.g., about ⅝", so as to narrow the adjacent space 40A at this point between pipes 38 and 39. The purpose of making plug 41 somewhat larger than pipe 39 is to provide additional mixing of the newly created large bubble dispersion in injector 22, but this plug enlargement may not be necessary to create the dispersion.

A series of small, spaced-apart holes 42 are further provided in the side wall of the lower portion of pipe 39. These holes should be sized large enough to avoid their plugging, yet still permit gas injection at high velocity to secure good mixing and minimize slugging of the surfactant mix flowing through the injector. For example, holes 42 may be from ⅛" to 1/32" in diameter and be from 4 to 10 in number which are located in and spaced around a portion of pipe 39 that extends from about 11" to 14" below its upper end. FIG. 2 of the preferred embodiment shows two vertically aligned holes 42 in each 90 degree quadrant of pipe 39, for a total of eight holes. Pressurized gas from pipe 28 in FIG. 1A is supplied to the lower end of pipe 39 and is evenly forced or injected through holes 42 into the annular space 40A between pipes 39 and 38.

The side wall of outer pipe 38 has an input opening 43 at its lower end and below holes 42 in pipe 39, which opening is connected to pipe 12 in FIG. 1 that carries the pressurized surfactant-liquid solution. This solution therefore enters the space 40A between injector pipes 38 and 39, flowing upwards and then through the upper output opening 22*a* of injector 22 into the pipe 31 that is connected to the stabilization coil 32 shown in FIG. 1. At the same time, gas from holes 42 in pipe 39 is injected into and mixed with this surfactant solution flowing through the annular space 40A. Injector 22 is considered to be the last component in the premix section of the FIG. 1A system.

Figure 3:
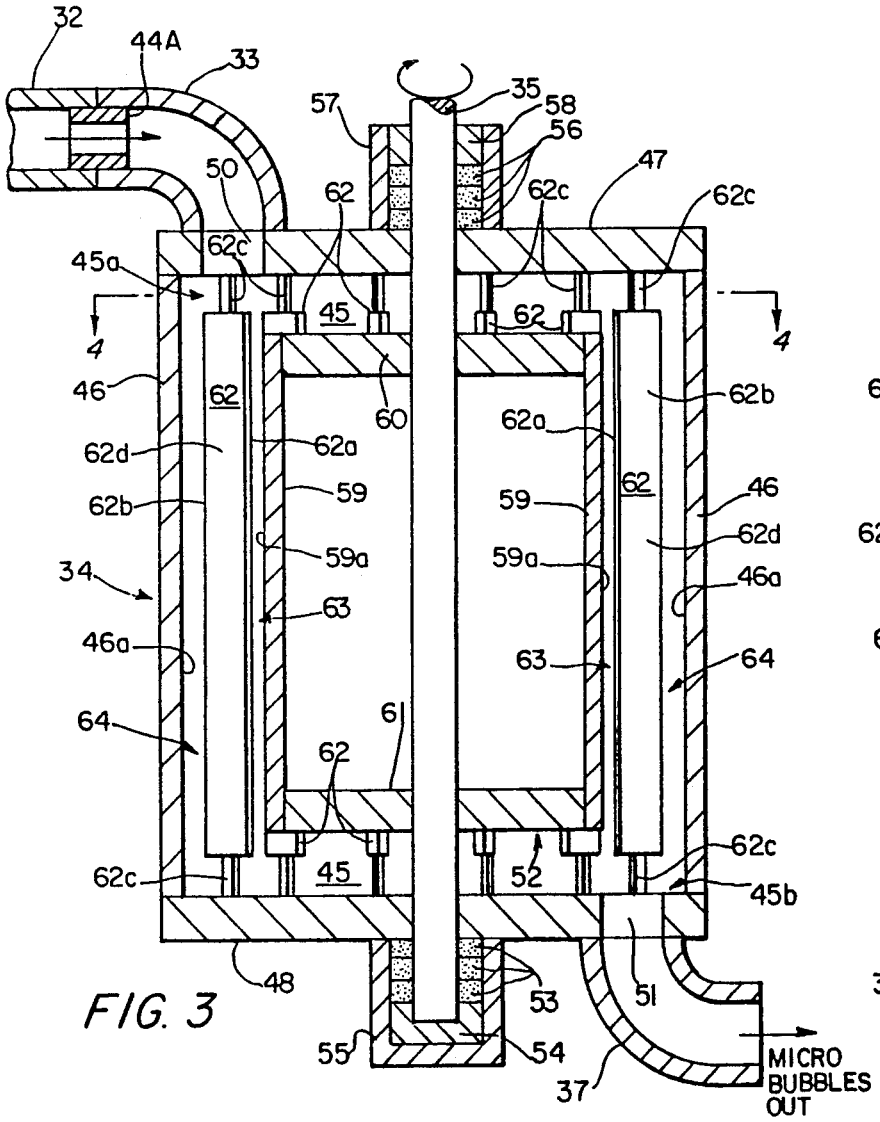

Pipe 31 may also have an inside diameter of about 1". A short tubular liner element 44 of about ¾" inside diameter is further provided at the junction of pipe 31 with pipe 32 near the upper ends of injector pipes 38 and 39. This liner 44 can be part of an adapter piece connecting these two pipes and, like the enlarged end plug 41 in pipe 39, also acts as a small restriction to the flow of the surfactant-liquid-gas mixture. A similar connecting restriction 44A can also be provided between pipes 32 and 33 as shown in FIG. 3. These restrictions also contribute to high turbulence plus increased turbulence points in order to obtain good mixing of the gas (e.g., 1 to 2 volume parts) and the surfactant-liquid solution e.g., 1 volume part) with minimum pressure drop.

As noted previously, pipe 31 also feeds this coarse dispersion mixture to the stabilization pipe coil 32 in FIG. 1A. In the preferred system embodiment, coil 32 is comprised of 1" inside diameter tubing whose length is adjusted to make the total length of pipe between injector 22 and generator 34 equal to about 40 feet. Physical space is conserved by coiling pipe 32. Pipes 31, 32 and 33 are considered to comprise the stabilization section of the FIG. 1A system. The primary purpose of this long pipe element is to allow enough hold time for the surfactant molecules to diffuse from the liquid to the gas-liquid interface before reaching the microbubble generator 34. This will enable the shearing operation in generator 34 to produce small CGA microbubbles and improve the quality of the dispersion. Moreover, if there is turbulent flow of the surfactant-liquid-gas mixture through coil 32, this will promote better mixing of these components for a more homogeneous input to generator 34. With 40 feet of 1" diameter pipe, the hold time therein for a 65% quality dispersion of 100 liters per minute flow is typically around 6.2 liters or 5.5 seconds if the line pressure is about twice atmospheric pressure. The Reynolds number for a flow of this nature is probably much greater than 4000 to 10000 which would indicate desirable turbulence. However, the need for the stabilization section, which includes pipe 32 and any extensions of pipes 31 and 33, becomes less important as the concentration of the surfactant increases from 150 to 250 to 350+ g/liter.

Figure 4:
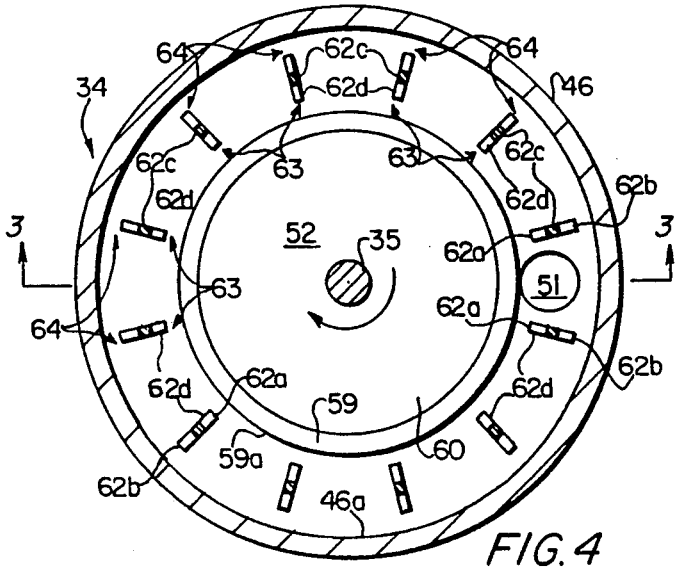
FIGS. 3 and 4 are elevation and plan partial sectional views, respectively, of one preferred embodiment of a novel microbubble generator used in the FIG. 1A system for producing a fine microbubble dispersion.

FIGS. 3 and 4 are elevation and plan sectional views, respectively, of one preferred embodiment of the novel microbubble generator 34 which receives the pressurized liquid coarse dispersion from the stabilization section of FIG. 1A. All materials used in this generator should be noncombustible for oxygen microbubble generation, with stainless steel and teflon being preferred. A stationary cylindrical chamber 45 is formed by a cylindrical outer shell member 46 acting as a curved chamber side wall, which preferably may be about 12" in diameter and from 15" to 16" high, that is bounded by opposite top and bottom end plates 47 and 48, respectively, with each plate having an inner surface. The terms "top" and "bottom" as used herein (and similar terms such as "upper", "lower", "above" and "below") refer only to the relative locations of components as shown in FIGS. 3 through 7, and not necessarily to their locations when generator 34 is in use since the generator also may be and is preferably operated in a horizontal position as shown in FIG. 8. The surfactant-liquid-gas coarse dispersion mixture from the long stabilization pipe 32 is admitted or enters at the top end of this chamber through elbow pipe 33 and an inlet opening or port 50 in the top end plate 47 near its perimeter. The generated fine microbubble dispersion is discharged from the bottom end of chamber 45 by way of a lower outlet opening or port 51 in bottom end plate 48 and through elbow pipe 37. Port 51 is located near the perimeter of end plate 48 and is also spaced 180 degrees around the center of chamber 45 from upper inlet port 50. Ports 50 and 51 alternatively may be located in the chamber side wall 46 at the chamber top and bottom ends, respectively, and on opposite sides of the chamber so as to also be spaced 180 degrees apart.

A rotating cylindrical member or rotor 52 is also mounted inside chamber 45 on a centered shaft 35 longitudinally extending through the rotor as its axis and which is spun by the exterior motor 36 of FIG. 1A. Shaft 35 longitudinally extends between and through holes in end plates 47 and 48. Its lower protruding end is surrounded by packing elements 53 and is seated in a bushing or bearing member 54 within housing 55. The upper exterior portion of shaft 35 between end plate 47 and motor 36 is also sealed by packing elements 56 in housing 57 which further encloses bearing member 58. However, other suitable means may be employed to support shaft 35 for rotation, and the length of shaft 35 also may vary according to its supporting means and manner of connection to rotor 52.

The rotor 52 may consist of an elongated tubular shell or pipe 59 having a longitudinal outer side surface 59*a* which is fixedly attached to shaft 35 by top and bottom rotor end pieces 60 and 61, respectively. Rotor 52 also is shorter than chamber 45 so as to define the chamber spaces 45*a* and 45*b* above and below the rotor, respectively. For example, rotor 52 may be approximately 12" high in order to provide about a 2" chamber space between it and each of the inner surfaces of end plates 47 and 48 that are from 15" to 16" apart. The coarse dispersion under pressure which enters through port 50 is distributed by upper chamber space 45*a* around the generator periphery and moves by plug flow down the length of rotor 52 for collection in lower chamber space 45*b* before leaving the generator as a fine microbubble dispersion. These spaces 45*a* and 45*b* result in about a 3.5" to 4" combined dead zone which is up and down stream of the spinning rotor. This zone represents about 6.5 liters, or a hold time of around 4.9 seconds, if the chamber 1.5 atmospheric for a 100 liter per minute flow of dispersion.

Chamber 45 in the embodiment of FIGS. 3 and 4 also incorporates a plurality of thin, longitudinally extending unperforated rectangular baffle plates 62 whose side surfaces 62*d* are radially aligned with respect to the axis of rotor 52. These baffle plates are generally evenly spaced apart around rotor 52 between it and the chamber inner side wall surface 46*a*. The number of baffle plates 62 preferably range from 4 to 12, but they should be spaced around the chamber so as not to block the inlet and outlet ports 50 and 51. These baffle plates permit the shearing of coarse gas bubbles into smaller CGA bubbles by the spinning rotor 52. As best shown in FIG. 3, the top and bottom ends of each baffle plate are attached by support elements 62*c* to the top and bottom chamber end plates 47 and 48, although the baffles can be fabricated as a separate assembly and then fastened in place within the chamber in such a way as to prevent their rotation. Different numbers and spacings of baffles can then be easily provided depending on the application. The outer diameter of rotor 52, rotor surface 59*a* and the horizontal width of the baffles 62 are coordinated so that a small clearance or gap 63 is provided between the rotor and the inner longitudinal edge 62*a* of each baffle. In the generator embodiment of FIGS. 3 and 4, small gaps or clearances 64 are also provided between the inner side wall surface 46*a* of chamber shell 46 and the outer longitudinal edges 62*b* of the baffles. For example, rotor 52 may be about 8" in diameter, while each baffle plate 62 is about 1" wide so as to make each of the gaps 63 and 64 approximately ½" wide if the chamber has a diameter of about 12", although gap 64 can be less than gap 63. In actual practice, however, the inner gaps 63 preferably may be from ¼" to 1" wide and the outer gaps 64 can also be from ¼" to 1" wide. For a chamber pressure of 1.5 atmospheres also with a 100 liter per minute dispersion flow, there are about 10.75 liters, or 8.2 seconds of hold time, as the dispersion passes through the annular high shear area in the generator. This hold time allows the coarse large bubble dispersion entering port 50 to be sheared to form a microbubble fine dispersion leaving port 51.

The cylindrical shell 59 of rotor 52 in FIG. 3 is also provided with a rough outer side surface 59*a* that assists in shearing the incoming surfactant-liquid-gas coarse dispersion into very small CGA microbubbles on the order of 45 +/−40 microns in size. One preferred technique for obtaining this rough surface is to provide rotor 52 with a plurality of projecting threads 65A and 65B which form the opposite or cross-direction helical patterns shown in the rotor diagrammatic elevation view of FIG. 7A. Threads 65A and 65B can be made of any suitable material, such as wires of metal which are wrapped in opposite circumferential directions around the outer side surface 59*a* of rotor 52, and each wire extends along the rotor's length in preferably a symmetrical helical pattern so that the two wires cross at various points on the rotor surface. For example, in the FIG. 7B diagrammatic top plan view of rotor 52, wire 65A is wrapped in a counterclockwise direction and downwardly extends around rotor 52 in a helical pattern, while wire 65B is wrapped in a clockwise direction and also downwardly extends around the rotor. Wires 65A and 65B cross at points 66*a* and 66*b* on the facing surface of the rotor position shown in FIG. 7A, and these wires also cross at points 66*c* and 66*d* on the opposite side of the rotor. Wires 65A and 65B can be held in their spaced-apart helical patterns around rotor 52 by any suitable means, and the ends of each wire may also be fastened in place on the top and bottom rotor end pieces 60 and 61 by any suitable means such as machine screws 60*a* and 61*a*. If needed for an adequate shearing function, the number of turns of wires 65A and 65B can be increased and spaced closer together, and/or additional wires 65 may also be wrapped around rotor 52 in opposite helical patterns. The wires 65 are preferably from 1/16" to ½" in diameter so as to project outwardly from the rotor surface, and the gap or clearance 63 between each wire and a baffle 62 is preferably from ¼" to 1" wide. Alternatively, the opposite helical patterns of FIG. 7A also can be machined or perhaps even cast, or otherwise formed, on the outer surface 59*a* of rotor 52, and are not limited to a wound wire or thread construction. Other rough rotor surface patterns may also be employed. However, rotor 52 should be dynamically balanced whatever may be the nature or configuration of its surface 59*a*.

Figure 7A:
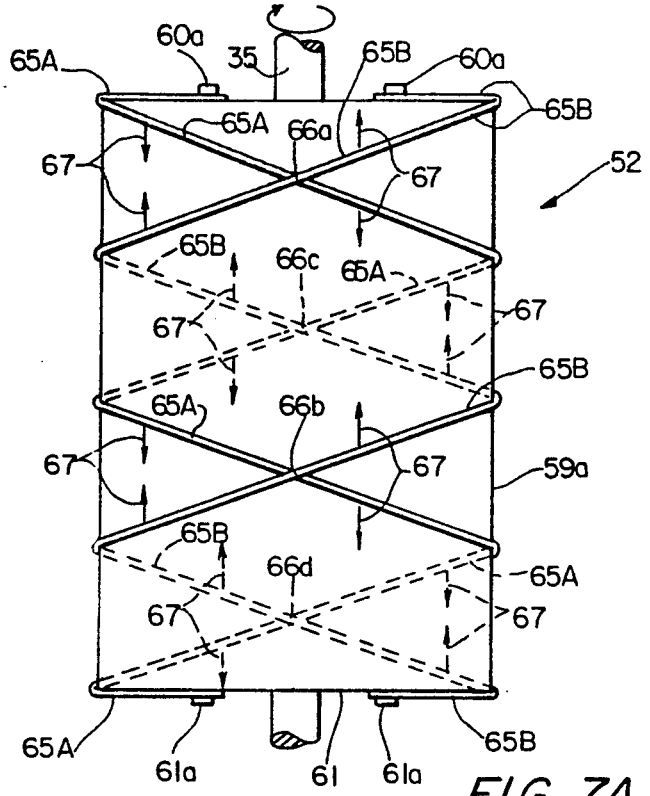
FIGS. 7A and 7B are diagrammatic elevation and plan views, respectively, which show a preferred construction for the surface of a rotor component used in the generator of FIGS. 3 and 4.
Figure 7B:
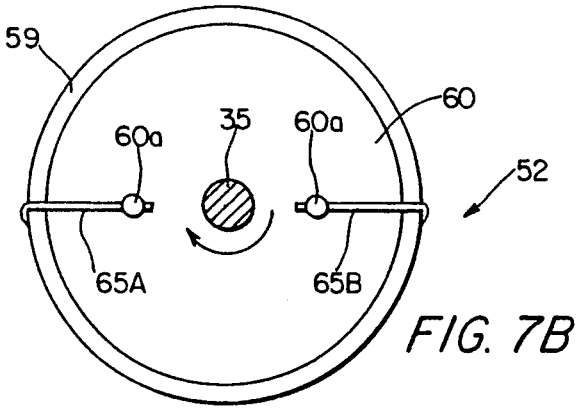
Figure 8:
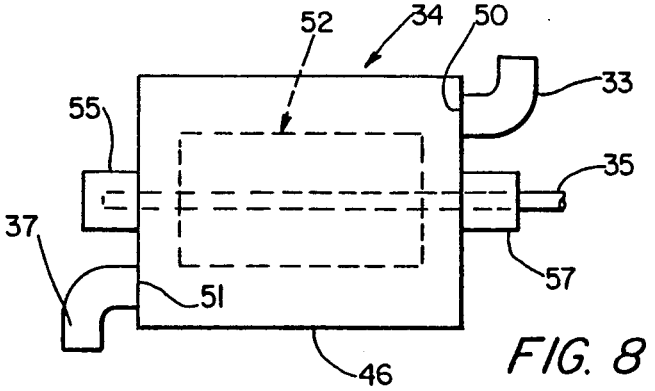
FIG. 8 is a diagrammatic view which shows a preferred horizontal position for the microbubble generator when in operation.

These FIG. 7A opposite or cross-direction helical patterns also provide a highly desirable and important reciprocating screw pump action by continuously moving various portions of the liquid dispersion adjacent or near to rotor 52 in opposite axial or longitudinal component directions as the rotor spins. As shown in FIG. 7A, the arrows 67 represent opposing axial or longitudinal components of motion of the dispersion adjacent to wires 65 as rotor 52 spins in a clockwise direction (FIG. 7B). By balancing the screw action of wires 65 so that little or no net downward or forward momentum to chamber space 45*b* is imparted to the dispersion by rotor 52, the dispersion directly in contact with the rotor is not pumped forward by rotor 52 so that all of the dispersion receives about the same amount of shearing between wires 65 and baffles 62 as it passes through the annular chamber volume. This absence of forward thrust prevents a significant number of large bubbles from leaving the generator unsheared or inadequately sheared. Along with the shearing caused by the wires 65, the reciprocating motion contributes to the shearing, and hence, to the production of the small microbubbles generated by the present invention.

Motor 36 in FIG. 1 also spins the rotor at a rotational velocity which is dependent on various factors such as the nature of the incoming mix, the size and surface roughness of the rotor, and the baffle size, number, spacing and clearance from the rotor. The rotor angular velocity thus may vary from about 1000 RPM to about 5000 RPM. A speed of about 1760 RPM has been successfully used for an 8" rotor.

It is also important to note that optimum results are achieved from the microbubble generator 34 when premixing of the gas, surfactant and liquid are completed using the long tubing 32 and/or the injector 22. Such premixing by these components apparently helps to initiate the establishment of an interface between the gas and the liquid-surfactant solution. A stabilized microbubble dispersion generally requires both proper shear and hold time in order to establish thermodynamic equilibrium.

Figure 6:
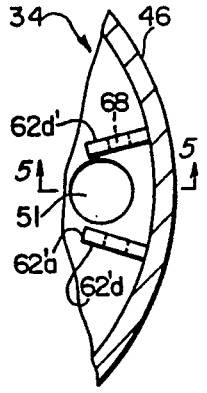
FIGS. 5 and 6 are partial elevation and plan sectional views, respectively, of an alternative construction for generator baffle plates shown in FIGS. 3 and 4.
Figure 5:
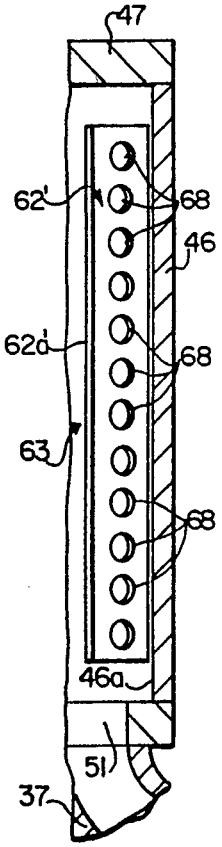

FIGS. 5 and 6 are partial elevation and plan sectional views, respectively, of an alternative construction for the baffle plates 62 in FIGS. 3 and 4. In FIGS. 5 and 6, the baffle plates 62' are wider and attached to the inner wall 46*a* of the chamber outer shell 46, thus eliminating the gap 64 and support elements 62*c* shown in FIGS. 3 and 4. However, each baffle 62' is instead provided with a plurality of holes or apertures 68 extending longitudinally along the baffle side surfaces 62'*d* and whose total combined area is designed to approximately match the area of each baffle gap 64 in FIG. 3. As the size of gap 64 decreases, the need for holes 68 increases. These holes 68 may be from ¼" to ½", in diameter. The gap 63, which is the most critical clearance, remains between the rotor and each baffle 62'.

It also has been found desirable to operate the microbubble generator 34 so that its rotor shaft or axis 35 lies in a substantially horizontal plane, as shown in FIG. 8, and with its inlet port 50 being uppermost and its outlet port 51 being lowermost.

From the above, it is apparent that many modifications and variations of the present invention are possible in light of the above teachings. It is therefore to be understood that, within the scope of the appended claims, the invention may be practiced otherwise than as specifically described.

What is claimed is:

1. Apparatus for continuously generating a liquid fine dispersion of small micron-size gas bubbles, comprising:

a chamber having a cylindrical inner side wall surface, a longitudinal axis, first and second opposite ends, an inlet at said first end for admitting a liquid course dispersion into said chamber, and an outlet at said second end;

an elongated cylindrical rotor rotationally mounted within said chamber between said chamber first and second ends for forming a microbubble fine dispersion from the liquid course dispersion in said chamber, said rotor being coaxial with said chamber and having an outer side wall surface, said outer side wall surface defining with said inner side wall surface of said chamber an annular space between said outer side wall surface and said inner side wall surface;

crossing helical members extending radially outwardly substantially equal distances from said outer side wall surface of said rotor; and a plurality of baffle plates spaced apart around said rotor and extending longitudinally in said annular space between said rotor outer side wall surface and said chamber inner side wall surface, said baffle plates being mounted in said chamber independently of said rotor and being oriented radially with respect to said longitudinal axis, and said baffle plates having an inner longitudinal edge spaced from said outer side wall surface of said rotor to define an inner gap.

2. The apparatus of claim 1, wherein said members comprises threads wrapped in opposite directions around said outer side wall surface of said rotor.

3. Apparatus for continuously generating a dispersion of small micron-size gas bubbles, comprising:

means for supplying a liquid surfactant solution;

means for supplying a gas under pressure;

means for mixing the liquid surfactant solution and the pressurized gas to form a liquid coarse dispersion of relatively large gas bubbles, said mixing means comprising:

an outer pipe having an interior volume, an inner side wall, an inlet in fluid communication with said solution supplying means, and an outlet spaced from said inlet; and an inner pipe located within said outer pipe, said inner pipe having an interior volume, an outer side wall spaced apart from said inner side wall of said outer pipe, an inlet proximate said inlet of said outer pipe and in fluid communication with said gas supplying means, and a plurality of spaced-apart holes through said outer side wall providing fluid communication between said interior volume of said inner pipe and said interior volume of said outer pipe;

means for generating a liquid fine dispersion of relatively small micron-size gas bubbles from the liquid coarse dispersion, said fine dispersion generating means being in fluid communication with said outlet of said outer pipe, said fine dispersion generating means further comprising:

a chamber having a cylindrical inner side wall surface, a longitudinal axis, first ad second opposite ends, an inlet at said first end in fluid communication with said outlet of said outer pipe for admitting the liquid course dispersion into said chamber, and an outlet at said second end;

an elongated cylindrical rotor rotationally mounted within said chamber between said chamber first and second ends for forming a microbubble fine dispersion from the liquid course dispersion in said chamber, said rotor being coaxial with said chamber and having an outer side wall surface, said outer side wall surface defining with said inner side wall surface of said chamber an annular space between said outer side wall surface and said inner side wall surface;

a plurality of baffle plates spaced apart around said rotor and extending longitudinally in said annular space between said rotor outer side wall surface and said chamber inner side wall surface, said baffle plates being mounted in said chamber independently of said rotor and being oriented radially with respect to said longitudinal axis, and said baffle plates having an inner longitudinal edge spaced from said outer side wall surface of said rotor to define an inner gap; and means for imparting axial motion components in opposite directions to various portions of the liquid dispersion, said axial motion imparting means being adjacent said outer side wall surface of said rotor; said axial motion imparting means comprising crossing helical members extending radially outwardly substantially equal radial distances from said outer side wall surface of said rotor.

4. The apparatus of claim 3, wherein said members comprises threads wrapped in opposite directions around said outer side wall surface of said rotor.

5. The apparatus of claim 3, wherein said outlet is spaced 180 degrees around said longitudinal axis from said inlet.

6. The apparatus of claim 3, wherein said baffle plates have an outer longitudinal edge spaced from said inner side wall surface of said chamber to define an outer gap.

7. The apparatus of claim 3, wherein said baffle plates have an outer longitudinal edge adjoining said inner side wall surface of said chamber, and wherein said baffle plates have a plurality of apertures extending therethrough.

8. The apparatus of claim 3, wherein said rotor has first and second opposite ends, said first end of said rotor being separated from said first end of said chamber to define a space therebetween for receiving the coarse dispersion admitted into said chamber through said inlet.

9. The apparatus of claim 8, wherein said second end of said rotor is separated form said second end of said chamber to define a space therebetween for collecting the fine dispersion for discharge through said outlet.

10. The apparatus of claim 3, further comprising stabilization means for primarily diffusing surfactant to a gas-liquid interface, said stabilization means being interposed between outlet of said outer pipe and said inlet of said chamber.

11. The apparatus of claim 10, wherein said stabilization means comprises a pipe having a length more than ten times that of said pipe of said mixing means.

12. The apparatus of claim 11, wherein said inlet of said chamber is located to one side of said chamber and said outlet of said chamber is located to the opposite side of said chamber, and where said generating means is positioned during its operation with said longitudinal axis of said chamber in a substantially horizontal plane with said inlet of said being uppermost and said outlet of said chamber being lowermost.

* * * * *